United States Patent [19]

Geering et al.

[11] Patent Number: 4,712,711

[45] Date of Patent: Dec. 15, 1987

[54] CONTAINER FOR TRANSPORTING HAZARDOUS CHEMICALS

[75] Inventors: Emil J. Geering, Grand Island; Frank J. Grano, Lewiston, both of N.Y.

[73] Assignee: Occidental Chemical Corporation, Niagara Falls, N.Y.

[21] Appl. No.: 355,280

[22] Filed: Mar. 5, 1982

[51] Int. Cl.[4] ..... B65D 25/14; B65D 51/18

[52] U.S. Cl. ..... 220/457; 29/456; 29/464; 29/525; 220/256; 220/288; 220/465

[58] Field of Search ..... 220/465, 466, 256, 288, 220/5 R, 457, 458; 285/206; 29/464, 456, 525

[56] References Cited

U.S. PATENT DOCUMENTS

| | | | |
|---|---|---|---|
| 1,643,252 | 9/1927 | McCrery | 220/5 R X |
| 1,651,317 | 11/1927 | Bell | 220/5 R |
| 1,800,082 | 4/1931 | Kniggf | 220/466 |
| 1,983,139 | 12/1934 | Lovell | 220/256 |
| 2,043,694 | 6/1936 | Battles | 220/466 X |
| 2,059,318 | 11/1936 | De Mercf | 220/465 X |
| 2,104,540 | 1/1938 | Hoffman | 220/256 |
| 2,521,098 | 9/1950 | Sebell | 220/352 X |
| 2,564,163 | 8/1951 | Lepertt | 220/404 X |
| 2,782,956 | 2/1957 | Richman | 220/256 X |
| 2,835,305 | 5/1958 | Boyer | 285/206 X |
| 3,103,224 | 9/1963 | Dearling | 220/256 X |
| 3,129,867 | 4/1964 | Schroeder | 220/404 X |
| 3,134,682 | 5/1964 | Vogel et al. | 220/458 |
| 3,177,014 | 4/1965 | Bergstrom | 285/206 |
| 3,463,349 | 8/1969 | Podesta et al. | 220/256 X |
| 4,164,304 | 8/1979 | Roberson | 220/465 |

FOREIGN PATENT DOCUMENTS

| | | | |
|---|---|---|---|
| 529930 | 7/1954 | Belgium | 220/256 |

*Primary Examiner*—Allan N. Shoap

*Attorney, Agent, or Firm*—James F. Tao; William G. Gosz

[57] ABSTRACT

An improved container is provided for transporting hazardous chemicals, and particularly chlorinated organic chemicals, such as benzoyl chloride. The improved container comprises a standard drum generally having a lining of a protective material, a removable cover, a rigid high density polyethylene bottle fitted inside the drum, and an inner lid fitted inside the drum and placed on top of the polyethylene bottle. The polyethylene bottle is provided with at least one (1) outlet projecting upwardly through a corresponding opening in the inner lid. At least one cap is provided for sealing the bottle against leakage of fluid, and the inner lid is securely fastened to the inside of the drum and to the polyethylene bottle.

7 Claims, 2 Drawing Figures

CONTAINER FOR TRANSPORTING HAZARDOUS CHEMICALS

BACKGROUND OF THE INVENTION

The present invention is directed to an improved container for transporting and storing hazardous chemicals which meets current regulations for interstate and international shipments, and prevents leakage and discoloration of chemicals.

Most hazardous chemicals are presently shipped in bulk, such as by railroad tank cars or tank trucks, or in all-steel drums which meet current U.S. Department of Transportation (hereinafter "DOT") and International Maritime Consultative Organization (hereinafter "IMCO") requirements. Such requirements have been interpreted to preclude the use of drums containing exposed plastic fittings or surfaces. Accordingly, the conventional open-head drums currently in use are fabricated almost entirely of steel, or some equivalent metal or alloy. However, since many chemicals commonly being transported in these drums will readily attack and corrode a steel surface, such drums are usually provided with an inner lining of a protective material, typically a phenolic resin, which is intended to be resistive to chemical attack. See, for example, U.S. Pat. No. 3,445,031 to Dubois et al, issued May 20, 1969, and U.S. Pat. No. 2,748,673 to Winstead, issued Mar. 9, 1951. Unfortunately, this type of protection is usually not adequate for the shipment and storage of many organic chemicals which readily attack or permeate conventional plastic linings and attack the steel inner surface of the drum. For example, some chlorinated organic chemicals, such as benzoyl chloride, hydrolyze upon contact with moisture in the drum to generate hydrochloric acid in situ. The hydrochloric acid readily attacks the inner lining of the drum, penetrating the lining to the inner steel surface. As a result, the hydrochloric acid degrades the lining and reacts with the steel surface causing discoloration of the benzoyl chloride. Such discoloration renders the benzoyl chloride unsuitable for use in many commercial applications. Furthermore, the interior surface of the drum can become sufficiently corroded so as to prevent reuse of the drum. In practice, therefore, the shelf life of conventional drums which are used to ship chemicals such as benzoyl chloride is frequently less than about three (3) months, after which time the quality of the benzoyl chloride will deteriorate substantially.

Various proposals have been advanced to develop improved containers for shipping benzoyl chloride. However, such proposals have not proven entirely successful. These proposals have, in general, involved two approaches: (1) modification of the interior of an existing steel drum which presently meets current DOT and IMCO standards, and (2) development of a new drum which will be exempt from DOT and IMCO regulations. As an example of the first approach, it has been suggested to use a low density polyethylene liner approximately 0.015 inches in thickness in a steel drum. However, it has been found that the benzoyl chloride in the drum will readily permeate the liner, causing discoloration of the bulk of the benzoyl chloride in a relatively short time. Steel drums with flexible plastic linings, such as disclosed in U.S. Pat. Nos. 2,748,673, supra, 3,918,605 to Butler, issued Nov. 11, 1975, and 2,912,136 to Redmond et al, issued Nov. 10, 1959, are similarly not suitable for transporting benzoyl chloride.

Plastic drums, such as disclosed in U.S. Pat. No. 4,094,432, to Zilbert, issued June 13, 1978, exemplify the second approach. However, the use of such drums in commerce requires a specific exemption from DOT requirements which is a time consuming procedure. In addition, although such plastic drums would be resistant to chemical attack by hydrochloric acid, they would also have a relatively low structural strength, even with a comparatively thick side wall section, which would prevent storage of such drums in heights of more than two tiers, even with the use of pallets.

U.S. Pat. No. 2,912,136, supra, discloses a drum with a metal cover and having a flexible bag-like liner with two (2) openings in the top wall portion fitted with liquid-tight rubber plugs. Since the liner is unsupported within the drum, rupture or failure of the liner represents a significant safety hazard to personnel involved in transporting and storing the drum and examining and removing its contents.

Accordingly, it is a principal object of the present invention to provide an improved drum for transporting hazardous chemicals which will meet current DOT and IMCO requirements, and can utilize existing materials and components of construction with minimal modification. It is a further object of this invention to provide a drum for transporting benzoyl chloride which will prevent its premature discoloration and leakage during shipment and storage.

SUMMARY OF THE INVENTION

In accordance with the present invention, an improved drum for transporting hazardous chemicals, such as benzoyl chloride, comprises a cylindrical metallic container having a lining of a protective material and a removable metallic outer lid. A rigid high density polyethylene bottle having at least one (1) outlet in its top portion is fitted inside the container. An inner lid having at least one opening corresponding to the bottle outlet is placed over the bottle so that the outlet projects through the opening. The outlet can then be capped to seal the bottle once it is filled with chemicals. Means for securing the inner lid to the interior of the container, such as indentations in the side of the container, and means for securing the bottle to the inner lid, such as flanged plastic fittings, are also provided.

DESCRIPTION OF THE PREFERRED EMBODIMENTS

Figure 1:
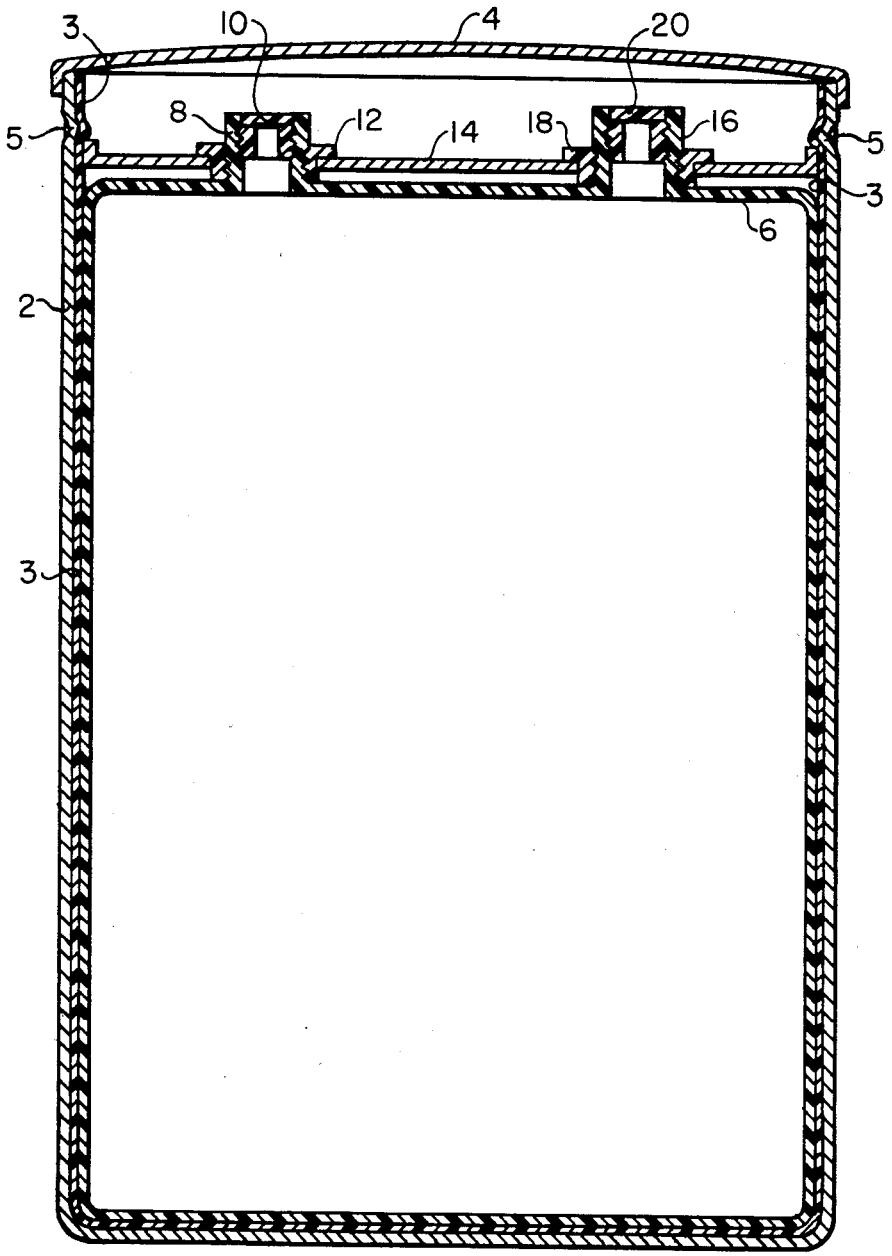
FIG. 1 is a side cross sectional view illustrating one embodiment of the present invention.

The improved drum of this invention is fabricated from standardized drum components, which, with some modification, are readily obtainable from commercial drum manufacturers such as Greif Brothers Inc. and Natico, Inc. The drum itself is a conventional steel container typically fabricated from 16 gauge steel, although other metals, such as nickel, or alloys will also suffice. The drum is approximately two feet in diameter and three feet in height with a liquid capacity of approximately 55 gallons. The drum may be suitably lined with a coating of a protective material generally provided by the drum manufacturer to the customer's specifications.

A typical plastic lining selected on the basis of its low cost and resistance to chemical attack is a phenolic (resole) resin having a thickness of approximately 0.005 inches. The drum is provided with a removable imperforate crown lid, i.e. a lid having a slightly concave surface, and can be suitably fabricated from the same materials as the drum. The lid can be conveniently fastened to the top of the drum by means of a circular retaining ring which is held together at its joined ends by means of a bolt. The outer lid then can be easily removed from the drum by simply loosening the bolt to detach the retaining ring.

A rigid high density polyethylene bottle is placed inside the drum. Preferably, the bottle is sized to take advantage of as much of the interior space of the drum as possible. Thus, the bottle is also preferably cylindrical in shape with an outer diameter slightly less than the inner diameter of the drum, and can be fitted inside the drum by any conventional means which does not crack or scratch the protective lining, such as by maintaining the bottle under partial vacuum.

The bottle is provided with at least one outlet projecting upwardly from the top portion of the bottle. In a preferred embodiment, where two outlets are provided, one outlet acts as a vent and is slightly smaller than the other outlet which is used for filling and unfilling the bottle with chemicals. The outlets can be threaded on both their interior and exterior surfaces for receiving plastic caps and fittings, respectively. The bottle can be conveniently manufactured using standardized methods for fabricating high density polyethylene containers, such as blow molding, rotational molding, and the like. It has been found that, although the thickness of the bottle is not critical, thicknesses of at least about 0.04 inches have superior resistance to permeability by chemicals such as benzoyl chloride. High density polyethylene is the material of choice for fabricating the bottle since other plastics such as epoxides, polyesters, polyamides, and low density polyethylene are readily attacked by hydrochloric acid and are thus not suitable for shipping or storing benzoyl chloride.

An inner lid is placed inside the drum covering the polyethylene bottle. The inner lid, which can be fabricated from a suitable metal or alloy, has openings corresponding to the bottle outlets and aligned with said outlets so that the outlets extend through the openings. Plastic fittings with upper flanged surfaces and internal threads can then be placed over the outlets to engage the external threads on the lower surface of the outlets. As the fittings are tightened, the flanged surfaces engage the inner lid thus securing the polyethylene bottle to the inner lid. Various other techniques can also be used to secure the bottle to the inner lid such as by using packing materials and the like.

It is also necessary to secure the inner lid to the inner surface of the drum. This can be accomplished using a variety of techniques such as by providing indentations in the side of the drum which project inwardly a sufficient distance to hold the inner lid in place, or by welding or press fitting the inner lid to the inner surface of the drum. A preferred location on the inner surface of the drum in this respect is the site of the rolling hoop. The inner surface of the rolling hoop can be packed with a suitable sealant, such as putty, to prevent escape of fumes or liquid into the space between the inner and outer lids.

The inner lid is an essential feature of this invention and serves a variety of functions. For example, when the drum is placed on its side to empty the contents, the bottle may fail causing the chemicals to spill. The inner lid supports and holds the bottle firmly in place and is substantially liquid tight so that such leakage is minimized. In addition, gases are frequently generated inside the bottle causing a pressure build up which must be vented. The inner lid thus also serves to minimize the risk of rupture of the polyethylene bottle under pressure, and allows venting of the pressure without exposure of personnel to an unsupported plastic vessel.

This invention will now be more particularly described by reference to the accompanying drawings.

As shown in FIG. 1, steel drum 2 is provided with a removable outer lid 4, an internal lining 3 of a plastic material, and indentations 5 for securing an inner lid 14. The drum contains a high density polyethylene bottle 6 with a small tubular outlet 8 for venting the bottle or sampling its contents, and a larger tubular outlet 16 for filling and emptying chemicals. An inner lid with two openings 14 is placed directly over outlets 8 and 16. As shown in the drawing, the outlets have external threads on their lower portion (adjacent to the bottle) and internal threads on their upper portion. Flanged plastic fittings 12 and 18 with internal threads can then be tightened over the outlets to secure the bottle to the inner lid as shown. Externally threaded caps 10 and 20 can then be tightened in place to seal the bottle.

Figure 2:
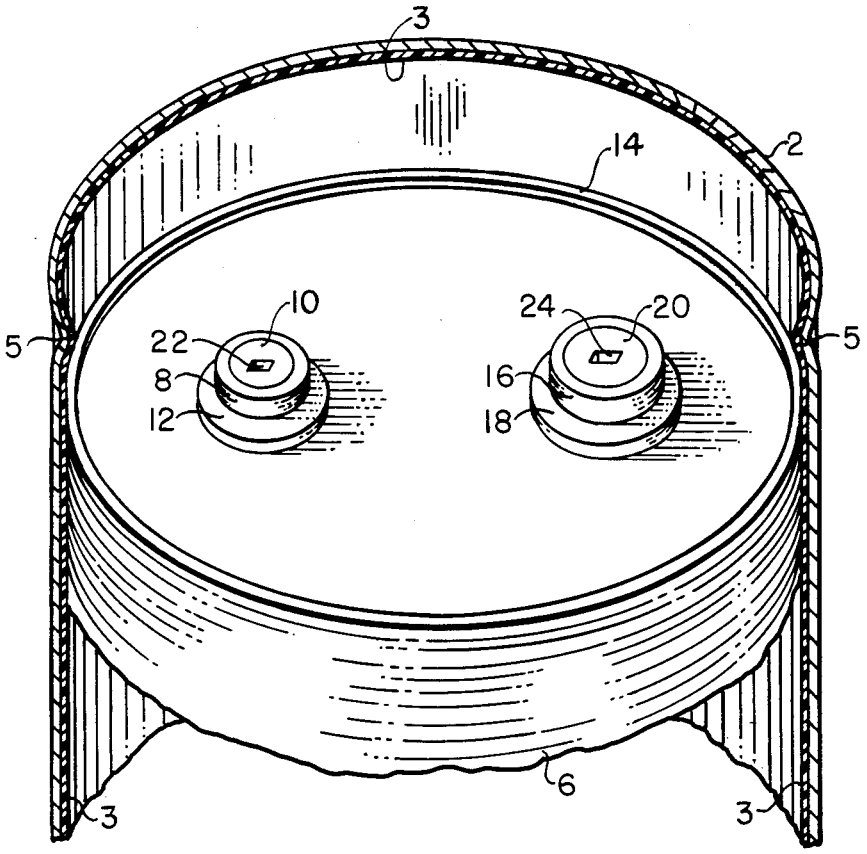
FIG. 2 is a partial perspective view of the embodiment of FIG. 1.

FIG. 2 is a partial perspective view of the drum 2 of FIG. 1 with protective lining 3 and with outer lid 4 removed. As shown in FIG. 2, inner lid 14 is circular and fits securely against the sidewall of the drum being retained by indentations 5. The flanges of plastic fittings 12 and 18 seat on the upper surface of the inner lid and also engage bottle outlets 8 and 16, respectively. Slots 22 and 24 are provided in caps 10 and 20, respectively, for conveniently tightening and removing the caps.

Although various embodiments of this invention have been shown and described in the specification, the invention is not intended to be limited thereby. For instance, the improved drum of this invention is useful for transporting and storing a variety of chemicals other than benzoyl chloride such as hexochlorocyclopentadine, benzyl chloride and benzotrichloride, to name but a few. It is to be understood, therefore, that the appended claims are intended to cover all such modifications and variations which are considered to be within the scope and spirit of the present invention.

What is claimed is:

1. In a cylindrical metal drum having a protective lining and a removable crown outer lid which is adapted to be secured to the exterior only of said drum, the improvement which comprises:

(a) a rigid high density polyethylene bottle fitted inside said drum, said bottle having two upwardly projecting outlets, one of said outlets serving as a vent for stored chemicals, (b) an inner lid adapted to be fitted entirely inside said drum on top of said bottle, said inner lid having openings corresponding to said bottle outlets permitting said outlets to extend through said openings, (c) means for securing said bottle to the inner lid, and (d) means for securing said inner lid to the interior only of said drum.

2. The drum of claim 1 which is fabricated from steel with a lining of a phenolic material.

3. The drum of claim 2 wherein said outlets are cylindrical and are threaded on their internal and external surfaces.

4. The drum of claim 3 wherein said bottle is secured to the inner lid with cylindrical, flanged plastic fittings having internal threads adapted to engage the external threads of said outlets.

5. The drum of claim 4 wherein caps for sealing the bottle are threaded into the interior of said outlets.

6. The drum of claim 5 which is provided with indentations in its internal surface projecting inwardly to secure the inner lid.

7. A method of improving the suitablility of a conventional metallic drum for storing and transporting hazardous chemicals, said method comprising the steps of (a) inserting a rigid high density polyethylene bottle inside said drum, said bottle having two upwardly projecting outlets, one of said outlets serving as a vent for stored chemicals, (b) fitting an inner lid entirely inside said drum on top of said bottle, said inner lid having openings corresponding to said bottle outlets permitting said outlets to extend through said openings, (c) securing said bottle to the inner lid, and (d) securing said inner lid to the interior only of said drum.

* * * * *